United States Patent [19]

Chang et al.

[11] 4,369,971

[45] Jan. 25, 1983

[54] ELECTRONIC BOWLING GAME

[75] Inventors: Richard S. Chang, Rolling Hills Est.; Richard S. Levine, Huntington Beach, both of Calif.

[73] Assignee: Mattel, Inc., Hawthorne, Calif.

[21] Appl. No.: 223,185

[22] Filed: Jan. 7, 1981

[51] Int. Cl.[3] ..... A63F 7/06

[52] U.S. Cl. ..... 273/85 G; 273/37

[58] Field of Search ..... 273/85 G, 85 R, 37, 273/54 R

[56] References Cited

U.S. PATENT DOCUMENTS

| | | | |
|---|---|---|---|
| 2,609,203 | 9/1952 | Bula | 273/85 R |
| 3,269,731 | 8/1966 | Koci et al. | 273/85 R |
| 4,008,893 | 2/1977 | Yoseloff | 273/37 |
| 4,114,882 | 9/1978 | Mau | 273/DIG. 28 |
| 4,283,049 | 8/1981 | Karlin et al. | 273/85 G |
| 4,311,310 | 1/1982 | Dankman et al. | 273/109 |

*Primary Examiner*—Vance Y. Hum
*Assistant Examiner*—Leo P. Picard
*Attorney, Agent, or Firm*—Reagin & King

[57] ABSTRACT

An electronic bowling game having indicia representing pins, indicia representing the path of a ball, and including an arrangement for varying the path to describe a large number of different curves between the release point and the pins.

7 Claims, 8 Drawing Figures

ELECTRONIC BOWLING GAME

This invention relates to electronic games and, more particularly, to an electronic bowling game.

Games have been popular throughout the ages. Those games which are related to and represent the play of sporting contests have been especially popular. The advent of semiconductor circuitry and especially of microcomputer circuitry has rendered such games even more popular. There are now small hand-held games on the market which allow one or more operators to play simulated games of football, basketball, soccer, and similar games.

These games are especially attractive because they are of such small size and require such a small amount of power (usually furnished by a transistor battery) that they may be used in almost any circumstances without intruding on or disturbing persons nearby.

One particular type of game has been especially difficult to realize in miniaturized electronic form. That type of game is one which in its original form requires the manipulation of mechanical equipment. This type of game poses a substantial problem, for the provision of the mechanical equipment or its representation by electronic circuitry is often impossible within the small space limits offered by these games. The attempt to represent the mechanical properties of a game electronically often nullifies the very characteristics of the game which originally made it popular.

Thus, there has been no realistic electronic hand-held bowling game produced to date. Attempts to incorporate a ball and mechanical pins into an electronic game so enlarge the size of the game as to make it no longer hand-held or portable. Furthermore, attempts to simulate a ball and pins, in general, eliminate the unique characteristics of the bowling game. For example, it has been impossible to represent the curve and spin which may be imparted to the ball in an actual bowling game. Furthermore, the representation of the action of pins which have been struck by a ball (pin action) has appeared to be impossible in a simulated game. Moreover, in order to provide the myriad of paths down which a bowling ball might normally travel, an infinite number of simulating devices would be expected to be required. For all of these reasons, there has been to date no realistic hand-held electronic bowling game devised.

Accordingly, it is an object of this invention to provide a new and improved electronic game.

It is another object of this invention to provide a new and improved hand-held electronic bowling game.

It is still another object of this invention to provide a hand-held electronic bowling game which represents mechanical features such as ball curve and pin action found in an actual bowling game.

SUMMARY OF THE INVENTION

The foregoing and other objects of the invention are accomplished by a portable electronic bowling game which has an exterior housing upon which are mounted switches for selecting the number of players which are to play the game and controls for positioning and releasing the ball. Within the housing and viewable from an upper surface thereof is a display which describes the path of the ball and the position of the pins which are the targets in the simulated game. The upper face of the housing also includes display means for presenting the score of the game at any particular time, the player presently bowling, the frame, and the like. The display and the controls are interconnected by a microprocessor which causes the display to simulate the movement of the ball along a myriad of paths, the falling of pins in the path of the ball, and pin action to eliminate other pins from play.

In the preferred embodiment of the invention, the operator may rock the housing to cause the movement of the means for simulating the path of the ball and thereby impart a curve to the simulated ball for knocking over the simulated pins.

Especially advantageous to the average player of the game is the fact that scoring in accordance with the rules of the game of bowling is entirely accomplished and displayed by the microprocessing circuitry so that the more intricate details of scoring need not necessarily be learned by the tyro before commencing play of the game.

Other objects, features, and advantages of the invention will become apparent by reference to the specification taken in conjunction with the drawings in which like elements are referred to by like reference designations throughout the several views.

DESCRIPTION OF THE PREFERRED EMBODIMENT

Figure 1:
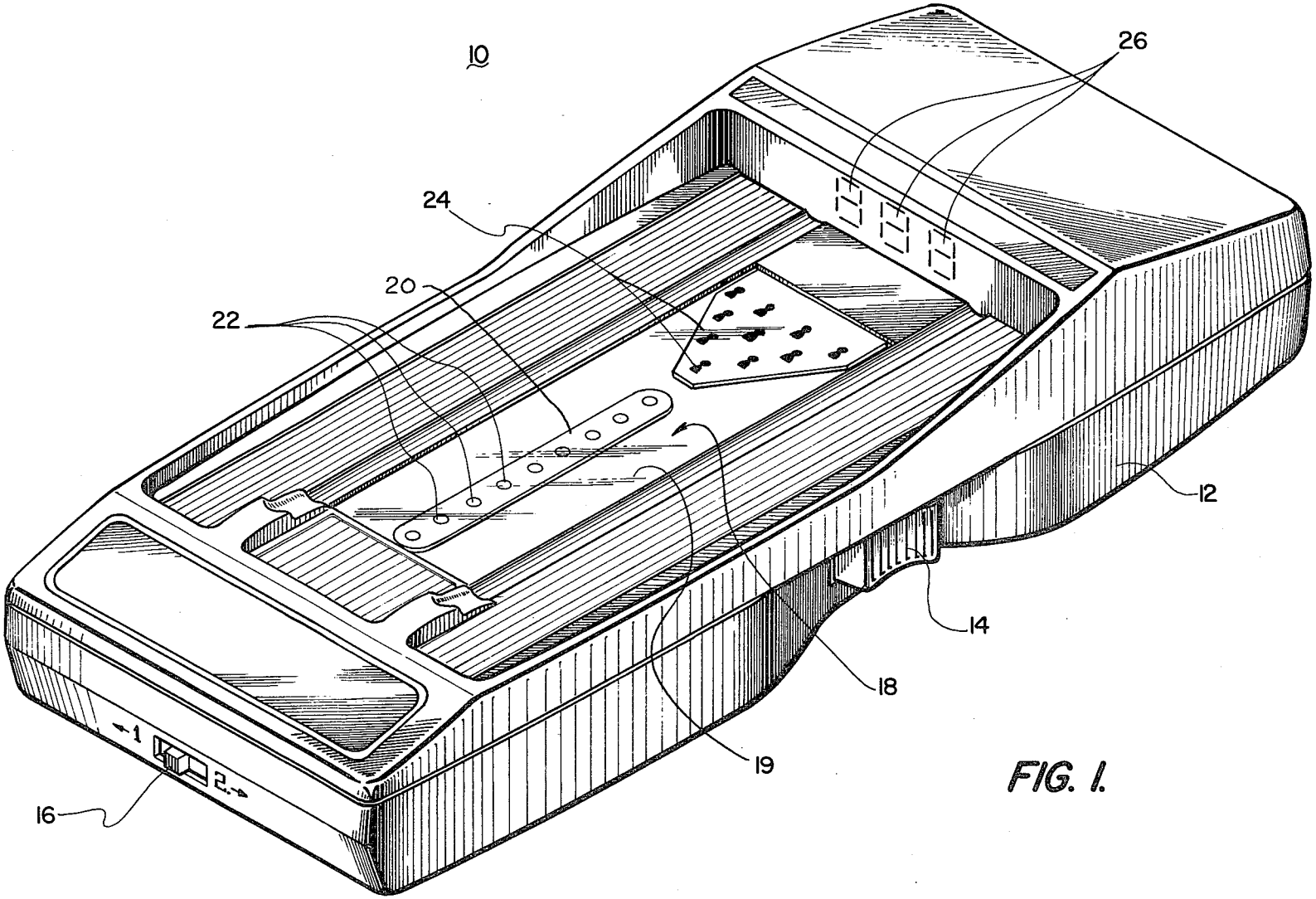
FIG. 1 is a perspective view of the exterior housing of an electronic hand-held bowling game constructed in accordance with the invention.

In FIG. 1 is shown a perspective view of an electronic hand-held bowling game 10 constructed in accordance with the invention. The game 10 comprises a housing 12 which may be conveniently formed of a moldable plastic material many of which are well known in the prior art. On opposite side surfaces of and projecting from the housing 12 are mounted a pair of positioning flippers 14 (only one of which is shown in FIG. 1) which may be utilized in the manner explained below for positioning a ball prior to releasing it and for selecting the speed of play. Also mounted to project from the surface of the housing 12 is a three position switch 16 which is used for applying power to the circuitry of the game 10 and for selecting either a one-player mode or a two-player mode.

The upper surface of the housing 12 mounts a display 18 which may be positioned below a transparent surface 19. The display 18 includes a movable strip 20 which physically mounts nine lights 22 (in an assembly not shown in FIG. 1) that may in the preferred embodiment be light emitting diodes (LEDs). The lights 22 describe a straight line from an initial position of the ball to the pins. The pins are simulated by a number of lights 24 which may also in the preferred embodiment be light emitting diodes.

As will be explained below, by squeezing together the two flippers 14 and moving them in unison to one side or the other of the display 18, the strip 20 may be positioned in one of several possible positions lying parallel to the length of the display 18. When the flippers 14 are first depressed after the game 10 is energized by placing the switch 16 in one of the two power-on modes, a speed for movement of the ball is selected. The particular speed (one through seven) depends on the position to which the strip 20 is moved. Once the flippers are released the speed is set for the entire game. Thereafter, the flippers 14 may be depressed to move the strip 20 to the position (which may be the same position) from which the ball is to be launched. Upon release of the flippers 14, a ball will be launched, its movement being simulated by serially lighting and extinguishing the lights 22 from the front lefthand end of the strip 20 (as seen in FIG. 1) to the rear righthand end of the strip 20.

The strip 20 is mounted in the preferred embodiment in such a manner that rotating the housing 12 from side to side about its lengthwise axis causes the strip 20 to move to the left or to the right. Since the strip 20 is moving across the display 18 while the lights 22 are being serially lit, the lights 22 describe a curved path for the ball such as the path which might be imparted to a spinning bowling ball in an actual bowling game. The position of the ball during passage is reviewed periodically by control circuitry included within the housing 12. The current position is compared with the former positions of the ball so that the ultimate path and position of the ball may be determined as the ball moves down the strip 20. This allows the pins represented by the lights 24 which would be contacted by a ball traveling the particular path to be removed from play in accordance with the curve of the path described. The control circuitry contained within the housing 12 also computes the point of contact of the ball with each pin in its path and determines a path for fall of each upended pin. The paths of upended pins are used to determine the fall of additional pins and thereby to provide the pin action of an actual bowling game.

After each throw of the ball, three LED digits 26, which are controlled by the control circuitry, exhibit in order the frame in which bowling is taking place, the player presently bowling, and finally the score for the particular player. On the first ball used by a player in any frame, the game 10 utilizes the display 26 to show whether any strikes or spares have been recorded during previous frames. The entire control of scoring is accomplished automatically by the control circuitry of the game 10 so that beginning players need not learn the idiosyncracies of scoring a bowling game.

Figure 2:
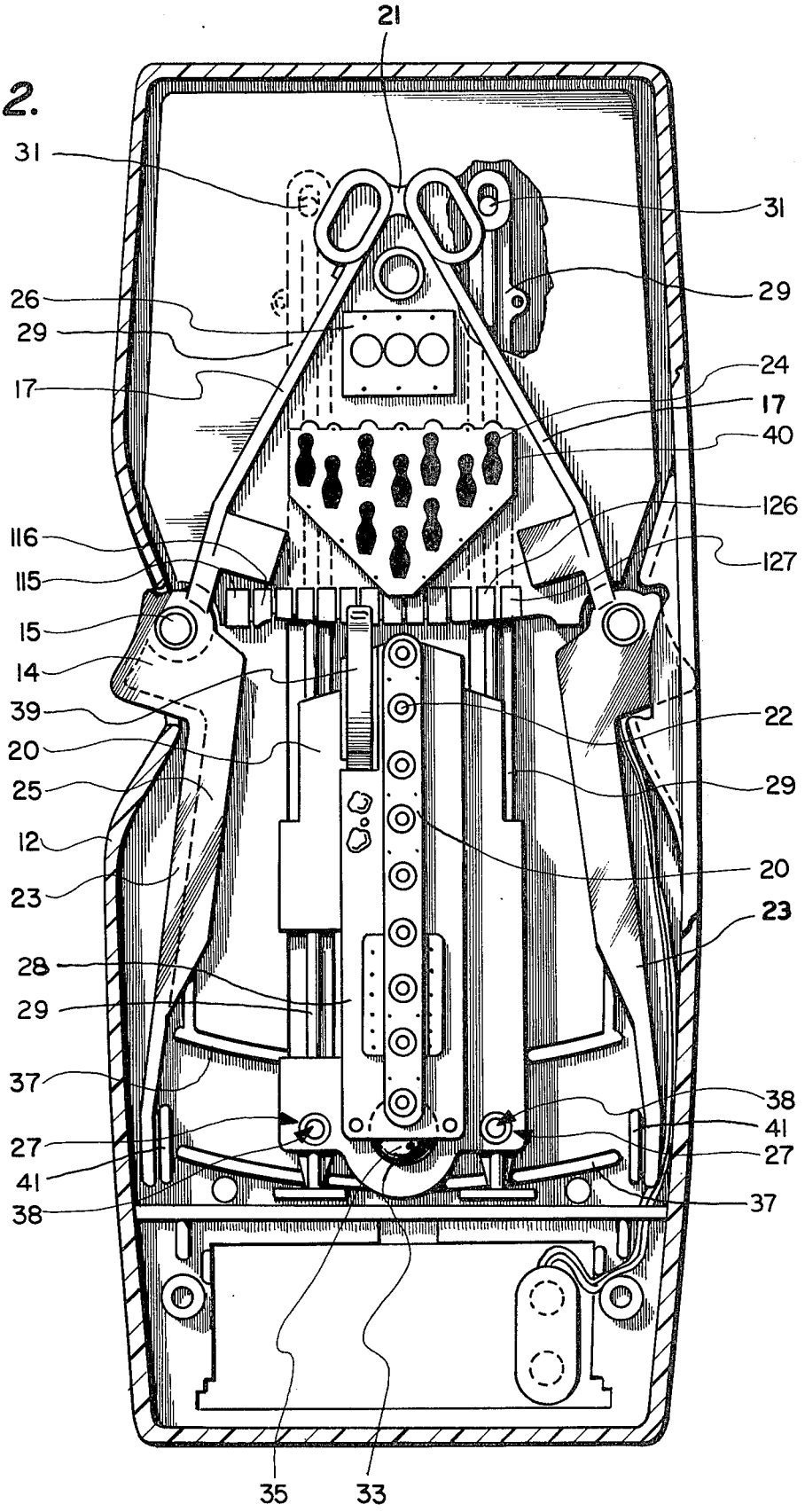
FIG. 2 is a top view, partially cut away, of the bowling game illustrated in FIG. 1.
Figure 3:
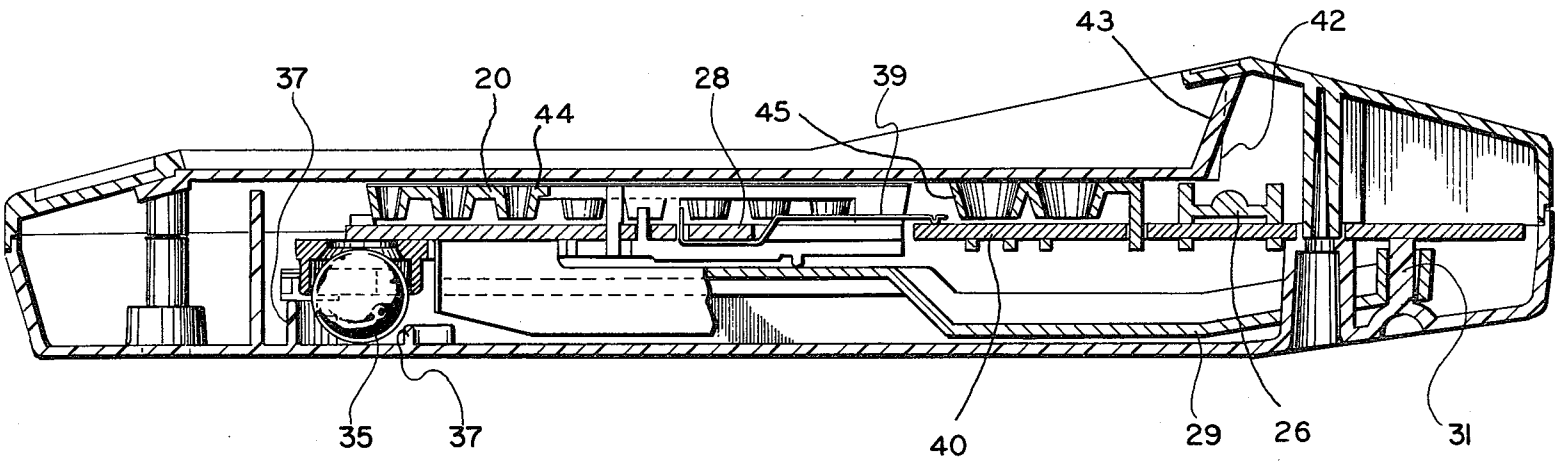
FIG. 3 is a side view, partially cut away, of the bowling game illustrated in FIG. 1.

Referring now to FIGS. 2 and 3, there are shown a top view (partially cut away) and a side view (partially cut away) of the interior of the housing 12 of the game 10 of the invention shown in FIG. 1. As is shown in FIG. 2, the housing 12 has indentations formed in either side in which are positioned the flippers 14. The flippers 14 are molded to rotate about a center 15 and have a long limber arms 17 extending into the interior of the housing 12. The movement of the arms 17 is restricted by tying them together with a web 21 which may be formed integrally with arms 17 during manufacture so that when the flipper 14 is depressed inwardly toward the interior of the housing 12, the extension 17 acts as a spring and returns the flipper 14 to its original position when released.

Molded as a part of each flipper 14 is also an extension 23 designed to project rigidly toward the lower end of the housing 12 as seen in FIG. 2. The flipper 14 to the right in FIG. 2 is a mirror image of the flipper 14 to the left. The projection 23 has a strengthening section 25 projecting at right angles to its plane. The entire flipper 14 with the arm 17 and the projection 23 may conveniently be constructed of one of the moldable plastic materials which are well known in the art.

As explained above, each of the lights 22 is mounted on the strip 20 which is supported by a platform 28. The platform 28 has a pair of holes 27 through which the platform 28 is rotatably mounted to a pair of arms 29. A pair of projections 38 extend upwardly from the arms 29 at right angles to the plane of the drawing in FIG. 2 and fit through the holes 27. The arms 29 each extend to one of two projections 31 (fixedly supported at right angles to the housing 12) to which they are rotatably mounted. The distance between the two projections 27 and the two projections 31 are equal so that the arms 29 swing the pivot points at projections 27 and 31, and the strip 20 is moved across the display 18 while maintaining the row of lights 22 parallel to the longitudinal axis of the housing 12.

The platform 28 has an aperture 33 therethrough below which is mounted a large circular bearing 35 (see FIG. 3) which may be constructed of steel. The bearing 35 moves in a path defined by a pair of walls 37 projecting upwardly from the bottom of the housing 12. The arms 29 support the platform 28 while the bearing 35 allows it to move freely (constrained by the walls 37) from side to side within the interior of the housing 12.

The right end of the platform 28 supports a projecting contact 39 which makes electrical connection to a number of terminals 115–127. As may be seen, the position of the contact 39 may be determined by electrically determining which of the contacts 115–127 the contact 39 touches at any particular time. Since the platform 28 is mounted to move freely on the arms 29 back and forth within the housing 12, the contact moves with the strip 20 and contacts one of the terminals 115–127 thereby providing an electrical position-determining signal.

As may be seen from FIG. 2, if the housing 12 is rotated along its longitudinal axis while the case of the housing 12 is held in a horizontal position, the strip 20 will move so that the terminal 39 contacts the terminals 115–127 in serial order (or reverse order). As is explained elsewhere in the specification, the position of the terminal 39 is utilized in determining the position of the ball at any particular time during the bowling sequence. It should be noted that the lowest numbered terminal 115 and the highest numbered terminal 127 both designate a gutter so that when the contact 39 is in a position contacting either of those terminals, a gutter ball is thrown.

By depressing the flippers 14 inwardly toward the interior of the housing 12, the extensions 23 at ends 41 may be forced against the platform 28 so that it may be moved from side to side by manipulation of the two flippers 14 together. Consequently, the terminal 39 may be caused to move across the terminals 115–127 to a selected position. This position is utilized first to pick a speed of play and second to pick a starting position for the ball.

As will be obvious to those skilled in the art, the housing 12, the flippers 14, and the various projections therefrom may be constructed from moldable plastic materials as is well known in the art. Obviously, other materials might be used. The platform 28 and the platform 40 which supports the pin-indicating lights 24 may be printed wiring boards upon which are mounted the other electronic components of the game 10 such as the control circuitry. It should also be noted that in the preferred embodiment the cover of the display 18 is formed in a transparent prism at 42 (FIG. 3) so that the LED digits 26 may be placed on the printed wiring board with the lights 24 yet will be displayed on the face 43 of prism 42 essentially perpendicular to the plane of the surface 19.

The assemblies 44 and 45 shown in FIG. 3 should be noted. Assemblies 44 and 45 form a number of light pipes for directing light to the surface 19 from LEDs mounted on the printed wiring boards in the preferred embodiment.

Figure 4:
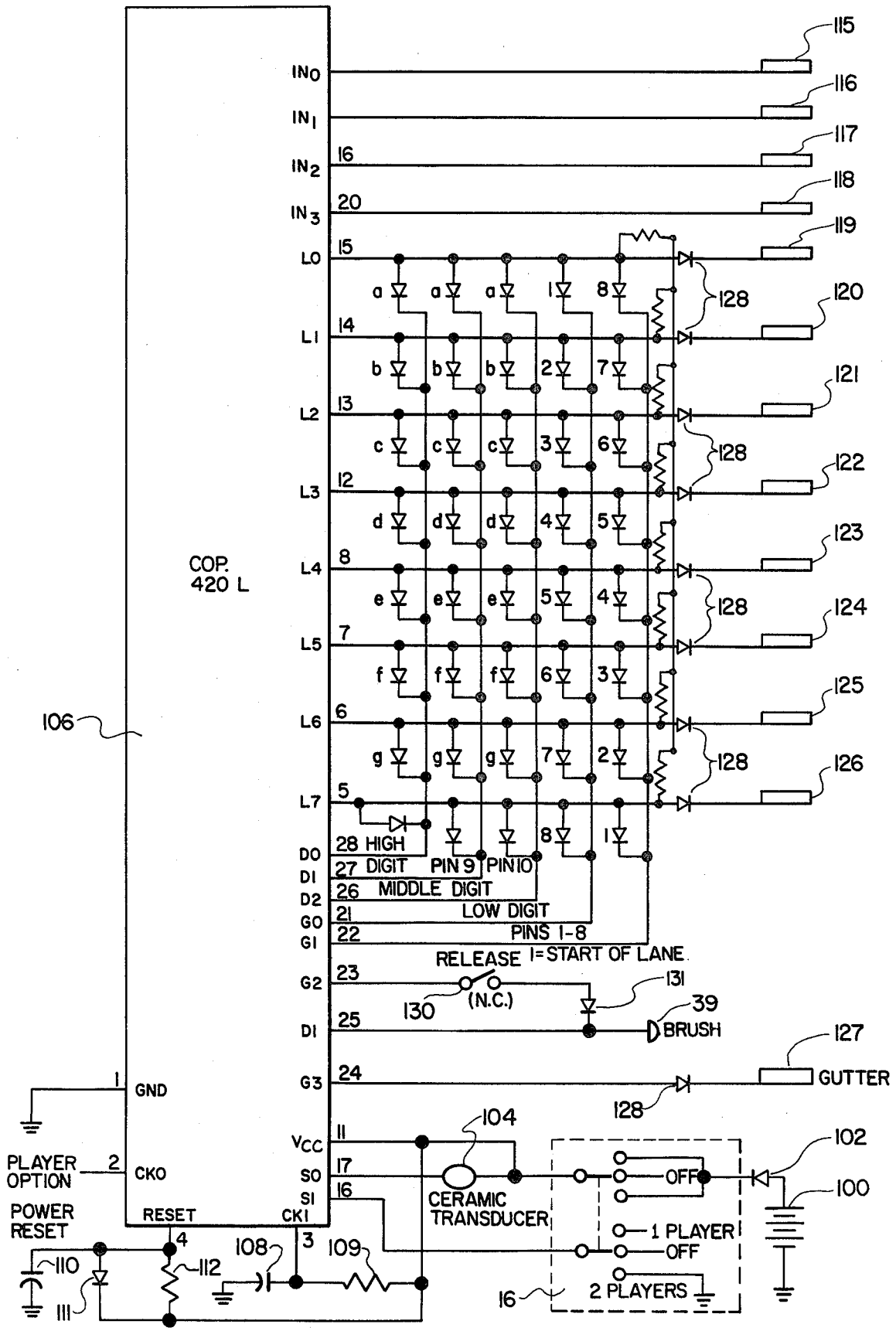
FIG. 4 is a partially-block/partially-schematic diagram of the circuitry utilized in the preferred embodiment of the invention.

Referring now to FIG. 4 there is shown a partially-block, partially-schematic drawing of circuitry utilized in implementing the preferred embodiment of the invention shown in FIG. 1. The circuit includes a battery 100 which in the preferred embodiment may be a nine volt transistor battery. The battery 100 is connected between ground and an isolating diode 102 which is in turn connected to a terminal of a three-position switch 16 described in FIG. 1. As may be seen in FIG. 4, when the switch 16 is placed in the upper position (the one player mode) the battery 100 is connected via the diode 102 to a terminal Vcc of a control circuit 106 and via a speaker 104 to a terminal SO of the circuit 106. When the switch 16 is placed in the lower position (two player mode), the same connections are made and ground is applied at a terminal SI on the circuit 106. The center position of the switch 16 disconnects the battery 100 from the circuit 106 and turns it off.

As will be understood by those skilled in the art, the control circuit 106 may be implemented in any of a number of different ways. However, as with many prior art electronic game circuits, the preferred embodiment of the invention utilizes an integrated circuit microprocessor, a miniature digital electronic computer. Such integrated circuit microprocessors are well known and include all of the input, output, memory, logic and control circuitry of a special purpose digital computer in miniature form. In general, such circuits have both random access memory (RAM memory) and read only memory (ROM memory). The RAM memory of the circuit 106 is utilized for storing various bits of transient information during the operation of the circuit 106. The ROM memory has connections formed by masking operations performed during the construction of the basic circuitry of the control circuitry 106 to provide a completely wired circuit which includes the program for controlling the operation of the microprocessor. Such an arrangement is often described as a dedicated circuit. When a manufacturer is provided with the specifications for the game play to be accomplished, the manufacturer is able to provide the masks for causing the connections to be made so that the game may be played in accordance with the invention.

Various microprocessor circuits are offered by a number of manufacturers and are well known in the prior art. The preferred embodiment of the present invention utilizes a COP420L microprocessor manufactured by National Semiconductor. Further information on the specific details of such microprocessor is available in the COPS CHIPS USER'S MANUAL published by National Semiconductor.

The terminal Vcc of the circuit 106 is also connected to a timing pulse generator circuit including a capacitor 108 and a resistor 109 and to a power reset circuit including a capacitor 110, a diode 111, and a resistor 112. The capacitor 108 of the timing circuit is arranged between ground and a terminal CK1 while the capacitor 110 of the reset circuit is arranged between ground and a reset terminal of the circuit 106.

A ground connection for the circuit 106 is provided at a GND terminal and battery is provided at terminal CK0 in the two player mode. A number of terminal switch pads 115–127 are provided which connect to terminals $IN_0$–$IN_3$, $LO_0$–$LO_7$, and $G_3$, respectively, of the circuit 106. The switch pads 119–127 are individually isolated from the terminals on the control circuit 106 by a number of isolating diodes 128 connected to each of the switch pads 119–126. Individual LED segments a–g, respectively, which form the high, middle, and low valued digits of the display 26 are connected to terminals $L_0$–$L_7$. The high digit LED segments are also connected to an input terminal $D_0$, the middle digit segments to an input terminal $D_1$, and the low digit segments to an input terminal $D_2$ of the control circuit 106. Also connected to the switch pads 119–126 through the diodes 128 are the lights (LEDs) 24 which represent the bowling pins on display 18 and the lights (LEDs) 22 which represent the positions of the ball on the strip 20. Eight of the LEDs representing the pins 24 are connected at an input terminal $G_0$, and eight of the LEDs 22 representing the ball positions are connected at the input terminal $G_1$ of the control circuit 106. The last ball position is connected to terminal $D_0$. Pin 9 is connected to $D_1$ and pin 10 is connected to $D_2$.

Also connected to the control circuit 106 at a terminal $D_3$ is a brush terminal 39 which contacts each of the terminal switch pads 115–127 at the different positions of movement of the strip 20 as was explained above. Brush 39 is connected by means of a diode 131 through a switch 130 which is operated by the operation of the flippers 14 to an input terminal $G_2$ on the control circuit 106. The switch 130 (though not shown in FIG. 2) may be mounted to be closed by the operation of the flippers 14 in a manner well known to the prior art.

Figure 6:
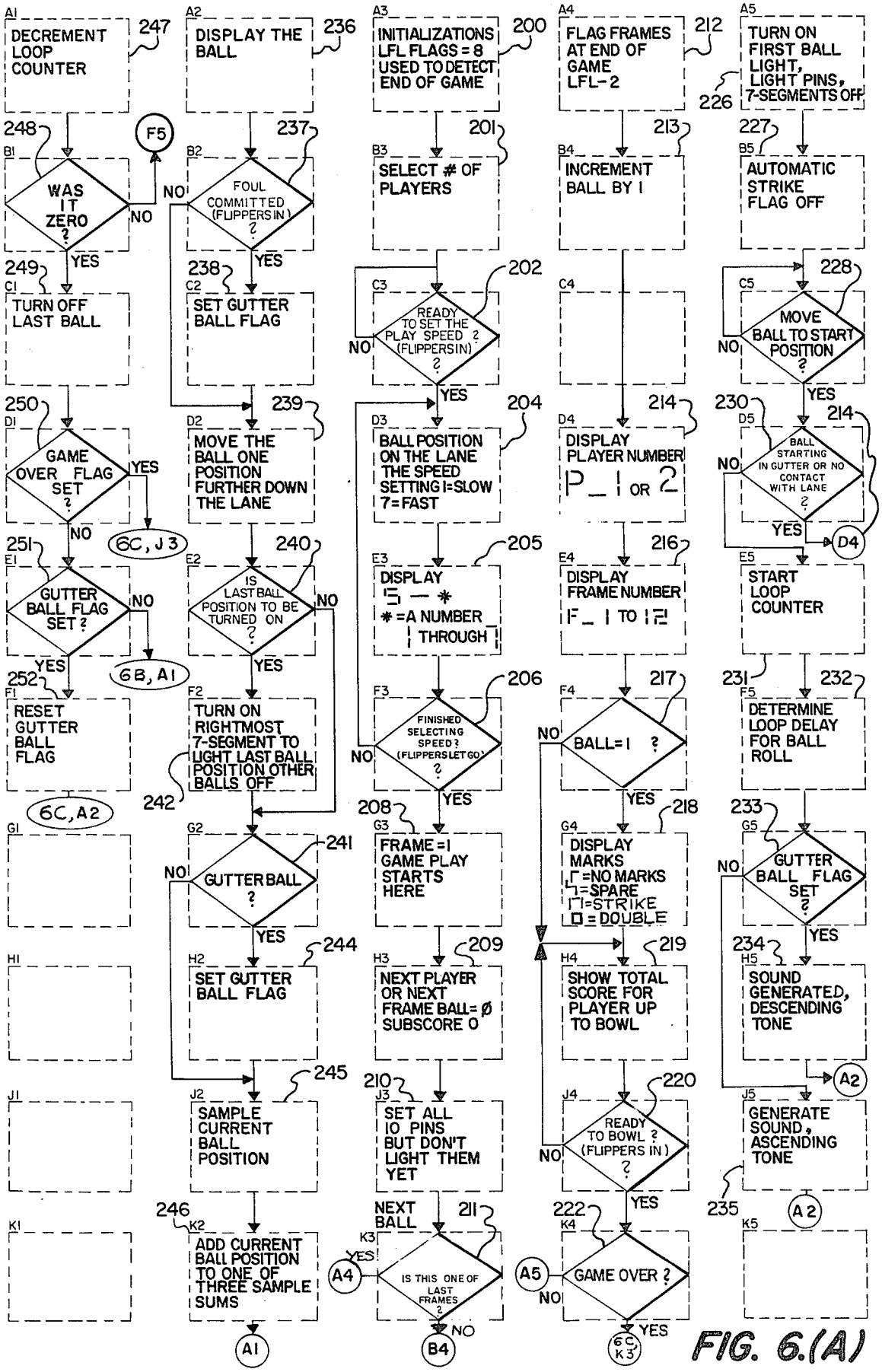
FIGS. 6(*a*)–6(*c*) are flow charts describing the operation of the preferred embodiment of the invention shown in FIG. 1.
Figure 6:
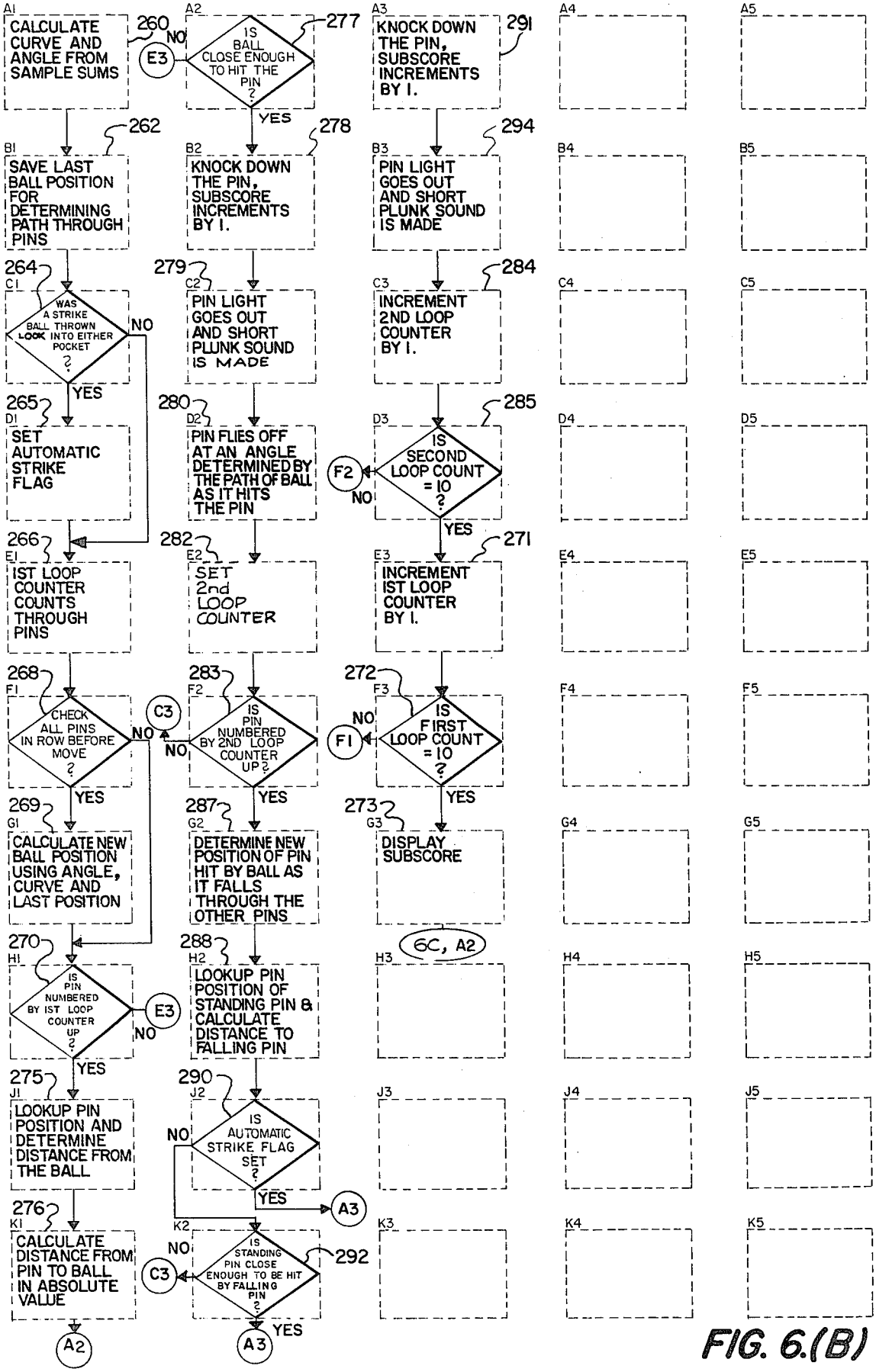
Figure 6:
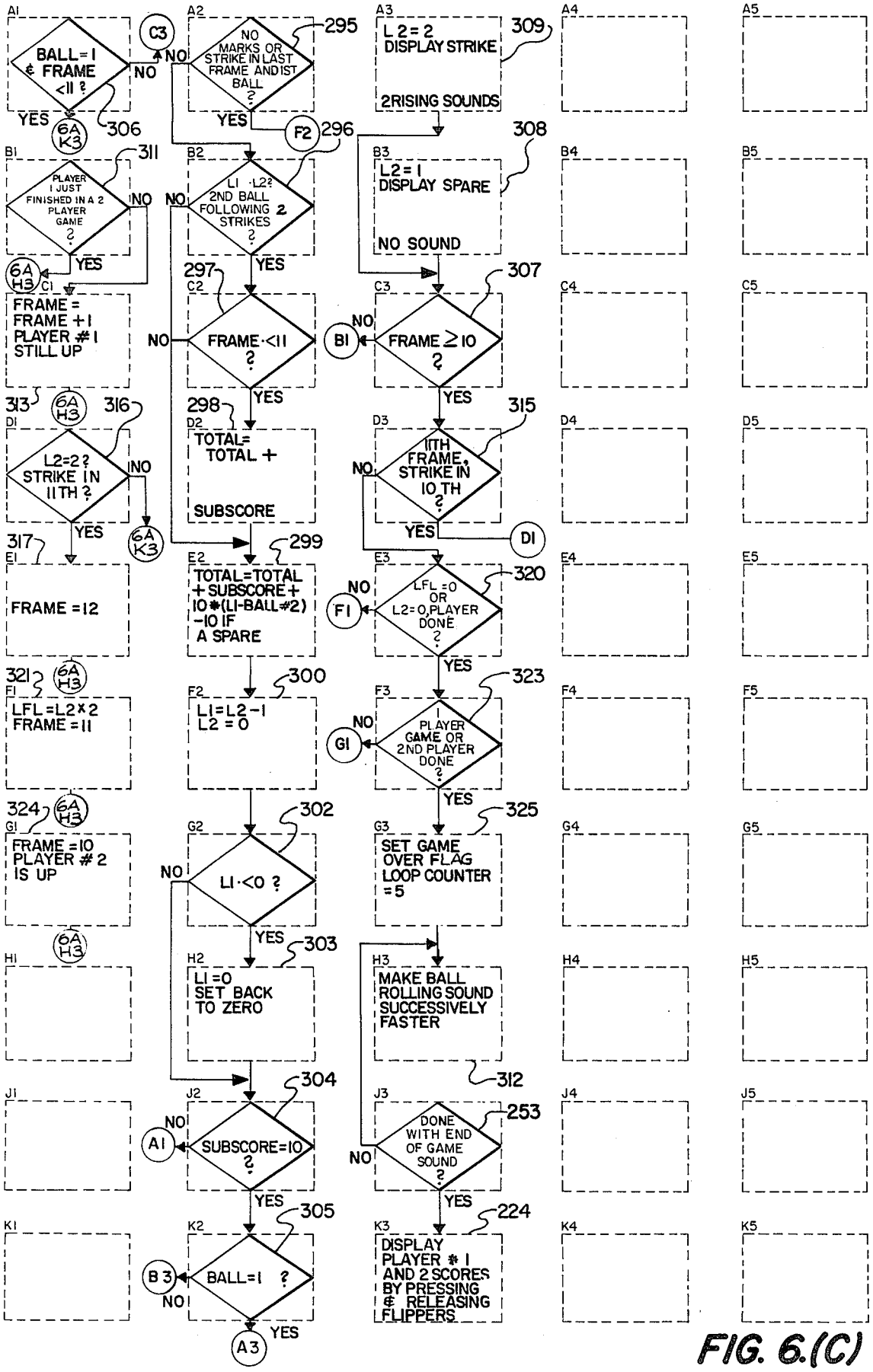

Referring now to FIGS. 6(*a*)–6(*c*), there are shown flow charts which together constitute a description of the operation of the preferred embodiment of the game 10. The program is entered at step 200 in FIG. 6(*a*) when the switch 16 is placed in either of the two positions for selecting either one or two players. At step 200 the initialization of the control circuitry of the game 10 takes place. Initialization includes storing an indication that the frame of play is not one of the last frames in the game. The program then proceeds to step 201 at which an indication is stored as to whether one or two players are involved in the game. From step 201, the program moves to step 202 at which it is determined whether the flippers 14 have been depressed. Flippers 14 are first depressed to move the strip 20 and the contact 39 therby to set the speed for play of the game 10. If the flippers 14 have not been depressed at this stage, the program recycles until the flippers 14 are depressed.

Once the flippers 14 have been depressed, the program moves to step 204 in which the position of the strip 20 is interrogated to determine which speed is to be utilized for play of the game. The program then moves to step 205 to cause the LED digits 26 to indicate the particular speed by showing an "S" followed by a number one through seven. The number indicates which of the seven speeds used in the preferred embodiment has been selected. From step 205, the program moves to step 206 at which it is determined whether the flippers 14 have been released. As explained above, the operator first selects a speed by depressing the flippers 14 and moving the strip 20 sideways from position to position. However, once a speed has been selected and the flippers 14 have been released at the beginning of a game, they may no longer be depressed except to select an initial position for each ball which is rolled. If at step 206 the flippers 14 have not yet been released, an initial speed may still be selected; and the program recycles to step 204 to determine the new position for setting the game speed.

Once the flippers 14 have been released, the program proceeds from step 206 to step 208 to store an indication that the first frame of play is about to take place. From step 208, the program moves to step 209 to store information that either the next player or the next frame will occur, to set the ball number counter to zero, and to set the subscore for the players to zero. It should be noted that in discussing the ball being thrown, ball one is the first ball thrown by a player in a frame and ball two is the second ball thrown by a player in the same frame.

From step 209, the program moves to step 210 to store an indication that all ten pins are to be illuminated when the game gets underway. The program then moves to step 211 at which a determination is made whether this is one of the last three frames or not. If this is one of the last three frames, the program moves to step 212 to set a flag which will indicate that the next frame to occur is the next of the last frames in sequence. From step 212, the program moves to step 213. The program also moves to step 213 from step 211 if this is not one of the last three frames. At step 213 the ball count for the frame is incremented by one. That is, if ball one has been thrown by a player, the ball count is moved to two; while if ball two has just been thrown by a player or if no ball has yet been thrown, the ball count is moved to one. From step 213, the program moves to step 214 at which the digits 26 are caused to indicate the player number as one (P1) or two (P2). On the first ball of the first frame, the indication is P1. From step 214, the program moves to step 216 to cause the digits 26 to display the frame number as one through twelve (F1–F12). The program then moves to step 217 to determine whether the ball to be rolled is ball one. If ball one is to be rolled, the program moves to step 218 to cause the control circuitry to cause the digits 26 to indicate any "marks" that presently exist in the game. If no marks exist (neither a strike nor a spare from a previous frame), a small "r" is shown by the rightmost digit 26; if a spare has just been rolled, a spare sign ( ⌉ ) is shown by the rightmost digit 26. If a strike has just been rolled, a ( ⌈⌉ ) mark is shown by the rightmost digit 26 while if two strikes have just been rolled, a double indication (⌈⌉) is shown by the rightmost digit 26.

If the ball being rolled at step 217 is not ball one, the program bypasses step 218 and moves directly to step 219. The program also moves to step 219 from step 218 after displaying the particular marks. By viewing the display 26 to determine whether any marks are shown or not, a player may determine not only whether his score will be increased on the next ball to be rolled because of a spare or a strike but also whether the first or second ball is presently being rolled.

At step 219, the total present score for the player about to bowl is shown by the display 26. The program then moves to step 220 to determine whether the flippers 14 have again been depressed indicating that the player is selecting an initial position for the ball from which to commence bowling. If the flippers 14 have not been depressed, the program recycles to step 219 and proceeds as explained above. If the flippers 14 have been depressed at step 220, the program moves to step 222 to determine whether the game is yet over. If the game is over, the program moves to step 224 of the flow chart shown in FIG. 6(*c*) at which the flippers 14 are used to cause the display to show the scores of the two players at the end of the game. By pressing and releasing the flippers 14, the two scores are displayed.

If the game is not yet over at step 222, the program moves to step 226 to turn on the light 22 nearest the operator and to light all of the lights 24 indicating the pins standing. At step 226, the program also causes the control circuit 106 to turn off all of the seven segment indicators comprising the digit display 26. The program then moves to step 227 to remove any previously stored indication that a strike has taken place and to step 228 to determine if the flippers 14 have yet been released so that the ball is ready to be thrown. If the flippers 14 have not yet been released at step 228, the program recycles until they are released. This allows the operator to move the initial position of the ball until satisfied. Release of the flippers 14 causes the ball to commence rolling.

Once the flippers 14 have been released, the program moves to step 230 to determine whether the ball is starting in the gutter or without having contact with a particular one of the seven lanes in which a ball may be thrown. If the ball is starting in the gutter or if the contact 39 on the strip 20 has not made contact with a lane terminal 116–126, the program recycles to step 214 to indicate the player bowling and the frame number and to continue as explained above. This allows a player who has lost track of the present frame to determine that frame merely by moving the starting position of the ball to the gutter.

If at step 230 the ball is starting in one of the prescribed lanes, the program moves to step 231 to set a counter which determines the position of the ball along strip 20 during its path to the pins. Since there are nine positions for the lights 22 on the strip 20 and since the first of these lights 22 is already lit, the counter will finally count through a sequence of eight additional positions. From step 231, the program moves to step 232 to recall from memory the speed setting used in determining the frequency at which the lights 22 are to be lit (and for determining the delay in proceeding through the program loop). The faster the speed, the less delay will be implemented in the loop. The program then moves to step 233 to determine whether the ball has been thrown in the gutter. If the ball has been thrown in the gutter, the program moves to step 234 to produce a sound on a speaker 104 which descends in tone as the ball rolls. A ball is rolled in the gutter when the strip 20 has moved so that its end adjacent the pins is in one of the two positions which fall at the righthandmost and lefthandmost sides of the display. This is caused by tilting the housing 12 too far to the right or left so that the contact 39 moves to the extreme right or left and contacts terminal 115 or 127. If the ball has not rolled into the gutter at step 233, the program moves to step 235 to cause a ball-rolling sound which increases in tone to be produced by the speaker 104. From each of steps 234 and 235, the program moves to step 236 to light the light 22 in the present position of the ball.

From step 236, the program moves to step 237 to determine whether the flippers 14 have been depressed since the ball has been released. According to the rules of the preferred embodiment, a movement of the flippers 14 once the ball has been released is considered a foul and treated as a gutter ball. This causes the program to move to step 238 to store an indication that a gutter ball has been thrown and that no score shall be added for the particular ball. If at step 237 the flippers 14 have not been depressed since the ball was released, the program moves to step 239. The program also moves to step 239 from step 238. At step 239 the ball is moved one position further down the strip 20. At step 240 a determination is made as to whether this new position is the last of the nine lights 22 on the strip 20. If this is the last ball position to be turned on the strip 20, the program moves to step 242 to illuminate the last position and then to step 241 to check again whether a gutter ball has been thrown. If at step 240 this is not the last position, the program moves to step 241 to check again whether a gutter ball has been thrown.

Figure 5:
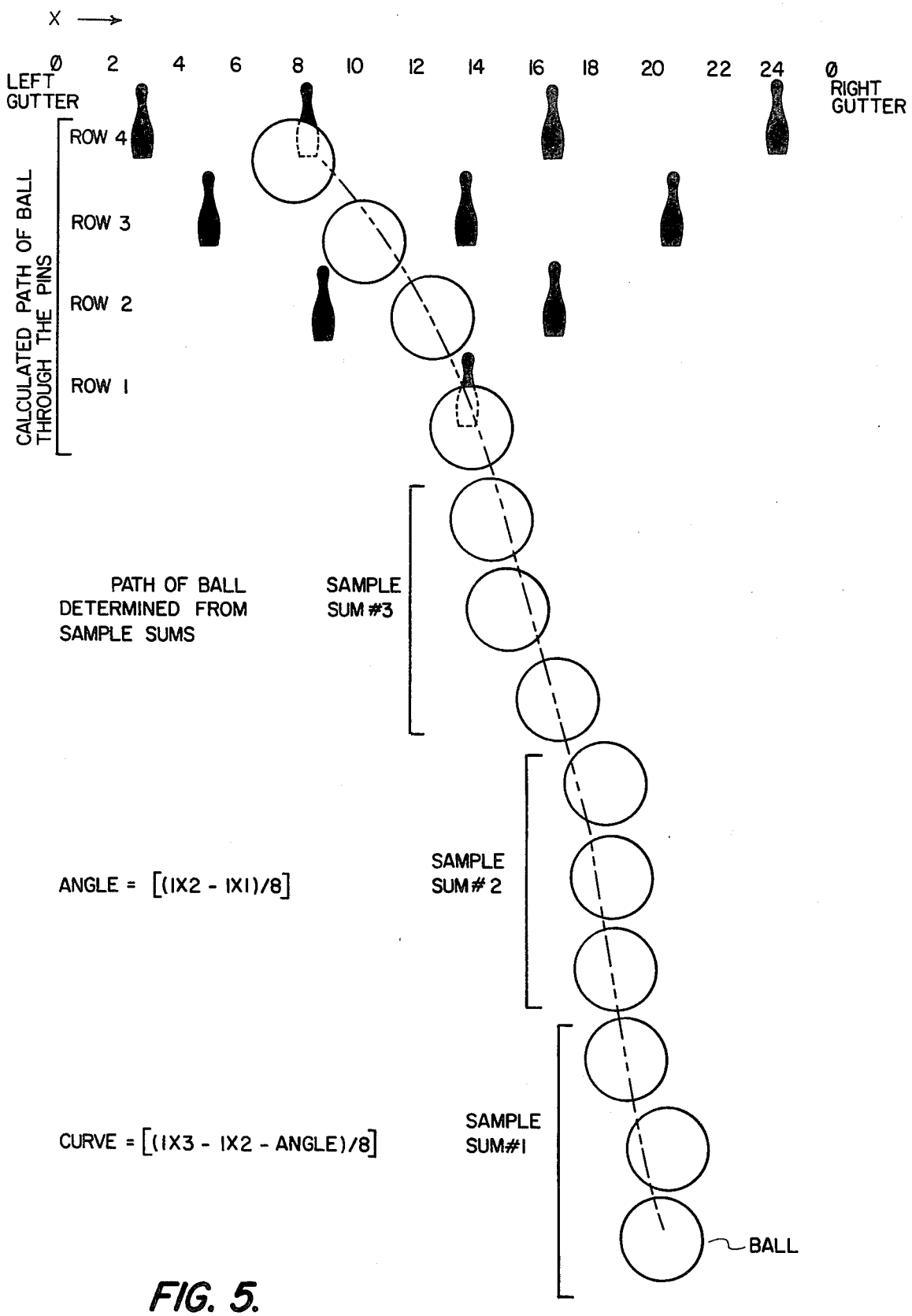
FIG. 5 is a diagram showing the path a ball takes in passing to the pins.

If a gutter ball has been thrown at step 241, the program moves to step 244 to store this indication and on to step 245. If a gutter ball has not been thrown at step 241, the program moves directly to step 245. At step 245 the current ball position is stored for later use in computing the angle and curve of the ball path so that the path through the pins may be determined. The ball position is a combination of the X and Y positions of the ball as will be understood from FIG. 5. FIG. 5 shows nine possible positions for the ball on its way to the pins. The X position is determined from the position of the brush 39 (across the top of FIG. 5) and the Y position from the loop counter setting. The program then moves to step 246 to add the current X value of the ball position to the sample sum with which it is to be used. From step 246, the program moves to step 247 to decrement the counter used to determine which one of the light positions 22 the ball is presently in. The program then moves to step 248 to determine if this is the zero position (i.e., has the ball passed beyond the ninth light 22 on the strip 20 and, consequently, is it moving through the pins). If the loop counter has gone to zero at step 248, the program moves to step 249 to turn off the last ball light 22 and step 250 to determine whether the game is yet over. If at step 248 the loop counter has not yet counted to zero, the program recycles to step 232 to determine the speed used for movement of the ball and recycles as explained above through the remaining lights 22 until the ball has stepped through each of the positions 22 and the loop counter has moved to zero.

At step 250, the program determines whether the game is yet over; and, if the game is over, moves to step 253 shown in FIG. 6(*c*) which will be explained below. If the game is not over at step 250, the program moves to step 251 to determine whether a gutter ball was thrown. If a gutter ball was thrown, the program moves to step 252 to remove this indication from memory and then moves to the scoring sequence shown in FIG. 6(*c*). If a gutter ball has not been thrown at step 251, the program moves to the flow chart shown in FIG. 6 (*b*) and proceeds to step 260.

The routine of FIG. 6(*b*) is entered at step 260. At step 260 the curve and angle of the ball are calculated from the sample sums which have been recorded at step 246 discussed above. FIG. 5 is a diagram showing nine positions of the ball as it traverses all of the lights 22 on its way to the pins 24. At each of the first three, middle three, and last three positions prior to contact with the pins, the sum of the three X positions of the ball is computed and is used to compute the angle and the curve of the ball. The values used for determining the X position of the ball at each light 22 are shown in FIG. 5 at the top of the figure. In the preferred embodiment, the angle of the ball travel is the difference between the sum computed in the middle three positions and the sum computed in the first three positions divided by a factor of eight and rounded to the first whole number. This, in effect, means that the angle of ball travel is related to the average variation in X distance between the positions of the ball over the middle three positions as contrasted to the first three positions during its traverse down the alley delineated by the lights 22.

The curve of the ball on the other hand is found in the preferred embodiment by subtracting the angle and the sum of the middle three positions from the sum of the last three positions and dividing by a factor of eight. This, in effect, means that the curve is related to the change in angle of ball travel over the last three positions from the angle originally determined using the first six positions. The factor of eight is chosen because of the particular details and dimensions of the preferred embodiment.

Thus the angle and the curve provide a representation of the direction in which the ball is moving and the amount in which that movement is changing as the ball approaches the pins.

After calculating the angle and curve, the program moves to step 262 which is used when the ball is at the last light 22 to store an indication of the last position of the ball before it moves into the first row of pins so that, using the angle and the curve, the path of the ball through the pins may be calculated. The program then moves to step 264 to determine whether a strike has been thrown. In the preferred embodiment of the invention, a strike is thrown if the pin is contacted by a ball traveling from an X position 10 or position 14 (see FIG. 5) and having an angle of one and a curve of minus one. As will be noted below, when a strike has been thrown, all of the pins will be upended. This is accomplished at step 265 at which an indication that a strike has been thrown is stored in memory. If a strike has not been thrown at step 264, the program moves to step 266 to set a counter which steps through each of the ten pins so that the pin and ball positions may be compared to determine whether the ball has come in contact with the pin in its traverse.

The program then moves to step 268 to determine whether it is time for the ball to move into the next row of pins (see FIG. 5). The ball moves into the next row of pins when each of the pins in the row in which the ball resides has been checked for contact by the ball. Consequently, once the number one pin (the first pin toward the initial position of the ball) has been checked, the ball moves from row one into row two. The program then moves to step 269 to calculate the position of the ball in row two using the ball position just prior to contacting the pins, the angle, and the curve of the ball. From step 269, the program moves to step 270. The program also moves to step 270 if at step 268 it is not yet time for the ball to move to the next row.

At step 270, the program checks to determine whether the next pin to be compared by the first loop counter is standing. If the pin is not standing, the program moves to step 271 to increment the first loop counter by one and then proceeds to step 272 to determine whether the count of pins has yet reached ten. If the count has not yet reached ten, the program then recycles to step 268 and proceeds as explained above. If the count of pins has reached ten, the program moves to step 273 to display the subscore for the frame and then continues as will be explained below.

If at step 270 the pin designated by the first loop counter is standing, the program moves to step 275 to determine the distance between that pin and the ball's present position as determined at step 269. The program then moves to step 276 to determine the distance (the X distance) from the ball to the pin and to step 277 to determine whether the ball is close enough to hit the pin. In the preferred embodiment of the invention, a pin standing within four units of distance will be hit by the ball. If the selected pin is not hit by the ball, the program moves to step 271 to increment the first loop counter and then proceeds as explained above. If the pin has been hit by the ball, the program moves to step 278 to knock down the pin and to increment the subscore for the frame by one. From step 278, the program moves to step 279 to turn out the light 24 at the pin position and to cause the speaker 104 to emit a sound emulating a pin falling. The program then moves to step 280 to compute the position of the pin which has fallen.

The position of a pin which falls is determined by determining where the ball which caused it to fall was when it hit the pin. If the ball was to the right, the pin falls to the left and vice versa. Any pin within approximately seven units of a falling pin in the direction in which the pin falls is hit by the pin and itself falls without, however, contacting any other pins.

The program moves from step 280 to step 282 in which a second loop counter is set to start with pin two (the rightmost pin in FIG. 5 in the second row of pins from the bottom). This counter counts through the pins and is used to determine whether any of the pins have been knocked over by falling pins. From step 282 the program moves to step 283 to determine whether the particular pin selected by the second loop counter is standing. If not, the program moves to step 284 to increment the second loop counter by one and to step 285 to determine whether the second loop counter has reached ten (all pins have been counted). The program proceeds to step 283 if the pin count has not yet reached ten. If the pin count has reached ten, the program moves to step 271 and proceeds as explained above.

If at step 283 the pin designated by the second loop counter is standing, the program moves to step 287 to determine the position of the pin which has just fallen and to step 288 to see whether that position is within seven units of the pin designated by the second loop counter. From step 288, the program moves to step 290 to determine whether the automatic strike flag has been set; and, if it has been set, the program proceeds to step 291. If the automatic strike flag has not been set, the program proceeds to step 292 to determine whether the pin designated by the second loop counter is close enough to be hit by the falling pin. If the pin designated by the counter is close enough, the program moves to step 291. If the pin is not close enough, the program moves to step 284 to increment the second loop counter by one and then proceeds as explained above.

At step 291, a pin close enough to the falling pin is upended, and the subscore of the player is incremented by one. The program then moves to step 294 to turn off the light 24 for the particular pin and to cause the speaker 104 to make a sound indicating a fallen pin. From step 294, the program moves to step 284 to increment the second loop counter by one, to step 285 to determine whether the second loop count has reached ten (whether all pins have been counted against each of the falling pins), to step 271 to increment the first loop counter by one, to step 272 to determine whether the first loop count has reached ten (whether all pins have been checked against the ball position), to step 273 to display the subscore for the player, and then moves to step 295 shown in the flow chart of FIG. 6(*c*).

Thus, with each ball roll which is not a strike, the ball position is checked against each pin position to determine whether the ball contacts the pin. As each pin falls, that pin position is checked against all other pin positions to determine which pins are dropped by pin action.

At step 295 in FIG. 6(*c*) a determination is made as to whether there has been a strike or no marks in the last preceding frame and whether this is the first ball in the frame. As will be recalled, in bowling the score of a strike is increased by the score of the next two balls and the score of a spare by the score of the next ball. If at step 295 the events did not occur, the program moves to step 296 to determine whether the ball which has been thrown is the second ball following two strikes in a row. If so, the program moves to step 297 to determine whether the frame number is less than eleven and, if so, on to step 298 to add the subscore an extra time for the player for frames less than eleven. The total score if the frame is eleven must include only the score for frame eleven (i.e., the subscore is not added twice). If this is not the second ball following two strikes in a row at step 296 or if the frame is eleven or greater, the program moves directly to step 299. The program also moves to step 299 from step 298. At step 299 the total score is computed.

From step 299 and from step 295 (if no mark or a strike occurred and this is the first ball), the program moves to step 300 at which the indications of marking in previous frames are reset for the next ball (indicates strike was two frames ago, etc.), then to step 302 at which it is determined whether these indications have proceeded past zero. If less than zero, the program moves to step 303 to set the indication regarding a strike two balls ago to zero and on to step 304. If the indication is not less than zero at step 302, the program moves directly to step 304. At step 304, a determination is made as to whether the subscore (the score for that particular ball) is equal to ten. If the subscore is equal to ten, the program moves to step 305 at which a determination is made as to whether this is the first ball thrown in the frame by the player. If the subscore is not equal to ten at step 304, the program moves to step 306 at which a determination is made as to whether the ball is the first ball of the frame and whether the frame is less than frame eleven. If the determination is yes at step 306, the program moves to step 211 to display player number, frame number, and score and await the player's pressing the flippers to position the ball as previously discussed. If the answer is no at step 306, the program moves to step 307.

If at step 305 the ball thrown is not the first ball of the frame, the program moves to step 308 to indicate a spare since ten pins have been upended on two balls. If, on the other hand, this is the first ball of the frame, the program moves to step 309 to cause the mark indicating a strike to be displayed, to cause a strike sound to be emitted, and to store an indication that a strike has occurred. From steps 308 and 309, the program moves to step 307 where a determination is made as to whether the present frame is the tenth or greater. If not, the program moves to step 311 where a determination is made as to whether the player who has just finished is in a two player game. If he is in a two player game, and the second bowler was up, the program moves to step 313 to place an indication that the first player is now up and to increment the frame number. From here, the program moves to step 209 and continues as previously discussed. If the player is not in a two player game, the program moves to step 313 to increase the frame number and to indicate that the first player is still playing. From step 313, the program moves to step 209 and continues as previously discussed. If player one was up in a two player game at step 311, the program places an indication that player two is now up and moves to step 209.

If at step 307 the frame is ten or greater, the program moves to step 315 to determine whether the frame marker indicates that this is the eleventh frame and that there has been a strike in the tenth frame. If this is the eleventh frame and there has been a strike in the tenth frame, the program moves to step 316 to determine whether there has been a strike in the eleventh frame so that the player has another ball. If there has been no strike in the eleventh frame, the program moves to step 211 to give the first player another ball because of the strike in the tenth frame. If there has been a strike in the eleventh frame at step 316, the program moves to step 317 to indicate that frame twelve is to be played and then moves to step 209 to give the player another roll.

If at step 315 it is not the eleventh frame or there has been no strike in the tenth frame, there must have been a tenth frame spare and the program moves to step 320 to determine whether the player is done playing. If the player is not done playing, the program moves to step 321 to set the frame presently being played as frame eleven and then to step 209 to give the player another roll. If the player is done at step 320, the program moves to step 323 to determine whether this is a one or two player game or whether the second player is finished. If this is not a one player game and the second player has not finished, the program moves to step 324 to set the frame equal to ten and to indicate that the player number two is presently playing. The program then moves to step 209 to give player two a chance to finish.

If at step 323 the game is a one player game or the second player is already done, the program moves to step 325 to store in memory an indication that the game is over and to set the loop counter to five. The program then moves to step 312 to make the ball rolling sound.

As will be understood by those skilled in the art, the teaching of this invention might be used in many games having a target and an object projected toward the target. Furthermore, many different programs may be utilized to implement the flow charts disclosed in this specification. Obviously, those programs will vary from one another in different degrees. However, it is well within the skill of the art of the computer programmer to provide particular programs for implementing each of the steps of the flow charts disclosed herein. It is also to be understood that various microcomputer circuits might be programmed for implementing each of the steps of the flow charts disclosed herein without departing from the teaching of the invention. It is therefore to be understood that, because various other embodiments may be devised by those skilled in the art without departing from the spirit and scope of the invention, it is the intention of the inventors to be limited only by the scope of the claims appended hereto.

What is claimed is:

1. An electronic game comprising means for providing indicia of a target representing bowling pins; means for providing indicia of a path of a bowling ball from an initial point toward the target, including means for providing a series of viewable points in the form of a series of lights mounted upon a platform in a line between the initial point and the target; means for moving the indicia of the path from a straight line between the initial point and the target while the path is being described, including mechanical means for moving the platform from side to side in a direction generally perpendicular to the path; and means for upending pins which lie in the path, and in which the platform comprises a strip, and the means for moving the platform includes a pair of arms rotatably mounted to the platform at a first set of points and able to rotate at a second set of points spaced apart the same distance as the first set of points.

2. An electronic game as in claim 1 further comprising means for selecting an initial point from a variety of initial points.

3. An electronic bowling game comprising a handholdable housing having display means providing target indicia representing bowling pins and path indicia representing the path of a bowling ball extending from an initial position to the target indicia, including a series of visual elements representing the position of the ball which are sequentially illuminable to describe the path; positioning means responsive to the input means for mechanically moving the path indicia from a straight line between the initial position and the target indicia while the path is being described in response to rotation of the housing about an axis generally parallel to the axis of the path; sensing means responsive to the positioning means for electrically sensing the position of the path indicia; and control means responsive to the sensing means for determining the direction of the ball as it travels through the pins.

4. The electronic bowling game of claim 3 in which the positioning means translates the path indicia along a first axis generally perpendicular to the straight line; and in which the control means includes means for sequentially illuminating the visual elements, means for determining sequentially the position of the ball along the first axis as each of the visual elements are illuminated, and means for determining the direction of the ball as it travels through the pins as a function of the sequentially determined positions of the ball along the first axis.

5. The electronic bowling game of claim 3 which further comprises means for selecting the initial position from a variety of initial positions, including second positioning means mounted to the housing for mechanically moving the path indicia to any one of a number of initial positions prior to the path being described, and in which the sensing means is further responsive to the second positioning means for electrically sensing the initial position, and the control means is further responsive to the sensing means for determining the initial position.

6. The electronic bowling game of claim 5 which further comprises means for selecting a speed at which the indicia describe the path from a variety of speeds, including means for causing the control means to determine the selected speed as a function of a particular setting of the initial position of the path indicia prior to the path being described.

7. An electronic bowling game comprising a handholdable housing having display means providing target indicia representing bowling pins and path indicia representing the path of a bowling ball beginning from an initial position and ending at a target position adjacent the target indicia, including a series of visual elements representing the position of the ball which are sequentially illuminable to describe the path and which are divided into a first group of elements located along the beginning of the path and including the initial position, a second group of elements located along the middle of the path, and a third group of elements located along the end of the path and including the target position; positioning means for mechanically moving the path indicia from a straight line between the initial position and the target indicia along a first axis generally perpendicular to the straight line while the path is being described; sensing means responsive to the positioning means for electrically sensing the position of the path indicia; and control means responsive to the sensing means for determining the direction of the ball as it travels through the pins, including means for sequentially illuminating the visual elements, means for determining the position of the ball along the first axis as each of the visual elements are illuminated, and means for determining the direction of the ball as it travels through the pins as a function of the sequentially determined positions of the ball along the first axis, including means for determining an angle of travel of the ball as a function of the positions of the ball along the first axis which are determined as each of the visual elements in the first and second groups of elements are illuminated, and means for determining a curve of the ball as a function of the angle of travel of the ball and of the positions of the ball along the first axis which are determined as each of the visual elements in the second and third groups of elements are illuminated.

* * * * *